US007798192B2

(12) United States Patent
Crum

(10) Patent No.: US 7,798,192 B2
(45) Date of Patent: Sep. 21, 2010

(54) METHOD AND SYSTEM FOR PREPARING WEBS WITH SEQUENTIALLY APPLIED PREVIOUSLY PREPARED SUBSTRATES

(75) Inventor: Jesse D. Crum, Fort Scott, KS (US)

(73) Assignee: Ward/Kraft, Inc., Fort Scott, KS (US)

( * ) Notice: Subject to any disclaimer, the term of this patent is extended or adjusted under 35 U.S.C. 154(b) by 1356 days.

(21) Appl. No.: 11/230,410

(22) Filed: Sep. 20, 2005

(65) Prior Publication Data

US 2006/0260757 A1 Nov. 23, 2006

Related U.S. Application Data

(63) Continuation-in-part of application No. 11/135,179, filed on May 23, 2005, now abandoned, which is a continuation-in-part of application No. 11/135,481, filed on May 23, 2005, now abandoned, and a continuation-in-part of application No. 11/135,131, filed on May 23, 2005, now abandoned, said application No. 11/230,410 is a continuation-in-part of application No. 11/151,571, filed on Jun. 13, 2005, and a continuation-in-part of application No. 11/166,858, filed on Jun. 24, 2005.

(51) Int. Cl.

| | |
|---|---|
| ***B65C 1/02*** | (2006.01) |
| ***B65C 9/06*** | (2006.01) |
| ***B65C 9/10*** | (2006.01) |
| ***B65C 9/14*** | (2006.01) |
| ***B65C 9/26*** | (2006.01) |
| *B65C 9/20* | (2006.01) |
| *B32B 37/12* | (2006.01) |
| *B32B 37/10* | (2006.01) |
| *B32B 38/10* | (2006.01) |
| *B32B 38/14* | (2006.01) |

(52) U.S. Cl. ..... 156/446; 156/230; 156/238; 156/247; 156/249; 156/285; 156/447; 156/DIG. 26; 156/DIG. 27; 156/DIG. 28; 156/DIG. 31; 156/DIG. 40

(58) Field of Classification Search ..... 156/230, 156/238, 247, 249, 285, 446, 447, DIG. 24, 156/DIG. 26–DIG. 28, DIG. 31, DIG. 37, 156/DIG. 40

See application file for complete search history.

(56) References Cited

U.S. PATENT DOCUMENTS

| | | | | | |
|---|---|---|---|---|---|
| 3,607,579 | A * | 9/1971 | Enskat et al. | ..... | 156/571 |
| 3,869,328 | A * | 3/1975 | Instance | ..... | 156/285 |
| 4,025,385 | A * | 5/1977 | Wood | ..... | 156/568 |
| 4,488,922 | A * | 12/1984 | Instance | ..... | 156/192 |
| 4,747,905 | A * | 5/1988 | Ilsemann | ..... | 156/542 |
| 5,464,289 | A * | 11/1995 | Beaudry | ..... | 400/62 |

(Continued)

*Primary Examiner*—Philip C Tucker
*Assistant Examiner*—Sonya Mazumdar

(57) ABSTRACT

The present invention relates to a system for producing an incrementally laminated web having a series of discrete, individual segments that are preprinted prior to being placed on the web. The system includes a supply of individual segments that are prepared by cutting one or more sheets that have been printed in a number of pre-determined areas. The segments are placed into a supply or hopper which supplies a feeder mechanism that places each segment individually on a rotary positioning cylinder. The cylinder, through use of a segment holding or receiving area then positions each of the segments on a traveling web in a particular arrangement ranging from slightly overlapping to spaced from one another.

1 Claim, 3 Drawing Sheets

U.S. PATENT DOCUMENTS 5,577,170 A * 11/1996 Karow ..... 358/1.11
5,863,628 A * 1/1999 Barry ..... 428/40.1
6,294,038 B1 * 9/2001 Majkrzak ..... 156/238
7,556,708 B2 * 7/2009 Phillips et al. ..... 156/250
2004/0123955 A1 * 7/2004 Kramer et al. ..... 156/564

* cited by examiner

METHOD AND SYSTEM FOR PREPARING WEBS WITH SEQUENTIALLY APPLIED PREVIOUSLY PREPARED SUBSTRATES

CROSS-REFERENCES TO RELATED APPLICATIONS

"This application is a continuation-in-part of application Ser. No. 11/135,179 filed May 23, 2005, now abandoned which is a continuation-in-part of applications of Ser. No. 11/135,481 filed May 23, 2005, now abandoned and Ser. No. 11/135,131 filed May 23, 2005 now abandoned; this application is a continuation-in-part of applications of Ser. No. 11/151,571 filed Jun. 13, 2005 pending and Ser. No. 11/166,858 filed Jun. 24, 2005 pending, the disclosures of each of which including that found in the claims is incorporated herein by reference."

FIELD OF THE INVENTION

The present invention is in the field of systems and methods for manufacturing incrementally laminated web assemblies from individual, previously prepared ribbons or segments of materials. More particularly, the invention is directed to the production of a number of printed sheets with each sheet having predefined discrete areas relating to specific jobs or applications. The sheets are then cut into individual segments, ribbons or strips, with each strip having a pre-printed area (text and/or graphics) pertaining to a specific job. Through the inclusion of a unique placer mechanism, and rotary positioning device, the segments or ribbons may be placed individually and directly on a web for processing and ease of handling. The web may then be subjected to additional processing steps to segregate the individual jobs for delivery to the end user customer.

The segments or ribbons, which are intended to represent discrete, individual preprinted areas on the sheet, with each area potentially representing a specific, individual order, can be used for a number of printed communication pieces such as labels, tags, cards, etc. The sheets are produced in part, initially from a pre-imaged or pre-printed sheet that is then converted or merged to a roll type of format through use of a placer mechanism.

The sheets are initially printed and preferably with high quality graphics or images that relate to the specific order. The sheets are then slit or cut to size to form templates, ribbons, surface elements or segments for the particular applications or jobs being produced. The segments are then converted to or merged with a continuously advancing web through the use of a unique rotary positioning device to create a continuous intermediate roll format that is achieved by placing the individual segments on the web in a sequential fashion. The segments that have been affixed to the web are then provided in one or more intermediate configurations to an end user.

More particularly, the present invention can be used to create pressure sensitive laminates that can be further manipulated to produce individual, prime labels, tags, cards, etc. that have a high or photo quality resolution level such as those greater than about 150 lines per inch and still preferably greater than about 300 lines per inch or approximately 2500 to 3500 dots per inch.

BACKGROUND OF THE INVENTION

Printed products, such as pieces that are intended to be used in business communications, can be delivered in a wide variety of formats, constructions and configurations. Normally, one of the most significant limiting factors for a manufacturer being able to produce a particular construction or expand product capabilities is the equipment the manufacturer has on hand to generate such printed pieces.

Traditional manufacturers of business communications, such as business forms and labels, are also usually limited in the type of jobs that a manufacturer will accept based on size of the job, or more particularly the order quantity or value of the order. That is, due to cost factors, a customer will not place an order with a manufacturer for a small to medium sized piece quantity as the set up or make ready of the job makes the order cost prohibitive, even assuming that the manufacturer would accept the order if a particular price could be obtained to justify production.

Such conventional manufacturers have normally produced product runs that range in the hundreds of thousands to millions or even tens of millions of pieces for a single order. As such, the equipment that is used to produce this level or quantity of product is then set up to handle only large manufacturing runs. The apparatus used in this type of fulfillment will normally only operate efficiently in this higher range of production quantities and often cannot be reconfigured. Thus, even if a manufacturer wished to pursue smaller runs or orders sizes, the manufacturer is faced with the dilemma of making new capital expenditures to purchase equipment that specializes in this type of application not to mention having to retrain existing personnel or hire and train new employees to generate this type of production activity.

Another drawback facing conventional manufacturers of business communication products is that in addition to the possibility of retooling the production infrastructure, the producers may also need to seek out new sales channels and distributors for products that fall within the smaller production run niche as the conventional sales channels are likely still focusing on procuring orders for larger production runs.

A still further drawback of trying to migrate to smaller customer applications relates to quality of the pieces that need to be generated. With the focus of the market slowly shifting to smaller runs, the end user is now demanding a greater image quality than that typically associated with conventionally printed products. It is believed that the reason for such far reaching changes is that budgets for marketing and business communications have been cut back in recent years and as such, end users want more from each piece that is produced rather than relying on the quantity of pieces to generate the desired result.

Flexography is one exemplary conventional technology that is commonly used today for the printing of decorative items, because of the ability to print multiple colors. Flexographic technology is commonly used in the rendering of packaging, marketing communications and normally will utilize a series of plates and one or more stations, containing inks, to apply colored images to the web as the web traverses the press. Through improvements in ink qualities and other modifications and enhancements in the technology, the image quality in flexographic presses and resulting products has improved to about 150 lines per inch.

Typically, for a point of reference, screens that have rulings of about 60 to 100 lines per inch are normally used to make halftone printed images for newspapers. Screens with about 120 to 150 lines per inch are commonly used today to produce images for magazines and commercial printing. Such screens are regularly produced by electronic dot generation.

Electronic dot generation is normally performed by computers that use unique screening algorithms in cooperation with electronic scanners and image setters to produce halftone images that are to be subsequently used to render an image. The pixels of digitized images are first assembled into dots that are then used to form shapes, sizes, rulings, etc. which create the ultimate image produced on the substrate.

While flexographic technology or flexography is desirable for use in such printing due to the economies that can be achieved when compared with other types of printing processes, such as lithography, there are a number of drawbacks in utilizing this process for certain applications. Initially, the quality is limited, despite improvements in the technology to about 150 lines per inch. This can make some complicated graphics appear "grainy." Other images such as those that use flesh tones or deep or rich colors, may look faded or "washed out." The effects of this level of image resolution can detract from the product appearance which may diminish the value of the technology and the products produced particularly for the prime label market. With increasing sophistication of consumers, as well as technology and expectations from each, such effects may be undesirable to potential end users.

Flexography also suffers from other drawbacks, such as the time that is involved in preparing a production job to run or "make ready" as it may otherwise be known in the industry. That is, the steps that are used to prepare the flexography equipment for running a particular job or order. This "make ready" process includes such activity as the preparation of multiple plates to produce the image at each station, mixing inks, calibration and alignment of the images between stations and the like.

Operation of the flexographic presses may also include multiple operators which can add to manufacturing costs. In addition, waste can also be a problem with such conventional printing technologies in that a number of feet, yards or meters of web material must be processed through the press in order to have the colors reach a predetermined threshold and to ensure appropriate registry of the stations as they are printing the images on the web. The amount of material wasted can be several times the length of the press or up to several hundred feet of material. The use of such volumes of materials obviously increases the cost of the operation. Thus, due to the make ready process and waste factors, the production of products (e.g. prime labels) through the use of flexography may then be limited to serving only certain market segments, namely large market segments. Markets that are applicable for this technology segment are generally believed to be those orders for large quantities of hundreds of thousands or millions of pieces, which potentially leaves the smaller label market, e.g. 100 to under a 1,000,000 labels, unfulfilled or at least not adequately served by currently available technologies due to cost and materials thresholds.

Business and marketing communication pieces including identifiers such as labels, business cards or tags may also be readily rendered using desktop equipment. While the resolution may be slightly improved when compared with conventional flexographic technology, speeds of application are significantly reduced as the images are processed in a sheet wise fashion on desktop equipment. This limited production rate results in only a few sheets per minute being produced as opposed to hundreds of feet per minute that are commonly capable of being processed by flexographic equipment. That is, the desktop unit may only handle and print one sheet at a time before the next sheet is advanced for printing or imaging when compared with a conventional web fed process which produces sheets at a faster rate. Thus, in using such a desktop process one may only be able to render a handful of sheets per minute as opposed to a flexography operation that may process several hundred feet per minute. Use of desktop processes is thus not likely efficient in trying to generate hundreds and certainly not thousands of labels, but may be useful in creating a few dozen labels for very small applications, such as a small home or small office environment.

What is needed, therefore, is a production method and system by which high quality graphics can be used to create products for a number of distinct, individual printing orders or applications. For example, each order can be produced with graphics that has a resolution in excess of about 150 lines per inch that can be produced in an efficient and cost effective manner, such as in a continuous system operating at greater than fifty feet per minute. Moreover, a system which can add substantial variability to the product as well as other features, such as embossments, over laminates, variable printing or imaging and the like, would greatly expand the penetration of high quality business communication in the marketplace by placing the pieces in the hands of the small to medium sized user.

BRIEF SUMMARY OF THE INVENTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

The present invention seeks to provide an intermediate web assembly that is capable of having a number of different discrete segments, representing a number of individual orders and composed of multiple pieces, e.g. labels, cards, tags, plastics, films and the like created in an efficient and cost effective manner. The segments will typically consist of a series of discrete individual elements with each element or segment having printing or imaging that includes graphical or resolution quality of about 150 or more lines per inch and preferably more than 300 lines per inch, which is approximately equal to about 2500 to 3500 dots per inch ("DPI") in order to create a high quality imaged product that is intended to be aesthetically appealing to the consumer and to more effectively communicate the business message of the application in the small to medium range market applications.

Surprisingly, it has been discovered that there is no readily available process or system by which a manufacturer can create high quality printed form product templates, in a continuous process with each of the templates or ribbons each having significantly improved graphic resolution that is greater than about 150 lines per inch, preferably greater than about 200 lines per inch and still more preferably about 300 lines per inch, in an efficient and cost effective manner.

Through the development of the present system and the creation of the unique intermediate web assembly described by using the present invention, the manufacturer can now service a particular niche market segments by creating high quality templates in a continuous fashion, such as those ranging from approximately 100 to 1,000,000 prime labels. While the foregoing market size or segment is a target area of the present invention, it should be appreciated that the invention may be practiced and used to fulfill larger order quantities, such as those of a million or more.

The pressure sensitive intermediate of the present invention is created through a unique sheet to roll process which provides savings specifically through reduced make ready time and generation of waste material and yields a higher image resolution product when compared with conventional processes such those produced by using conventional flexographic technologies.

The present invention uses previously prepared individually created sheets, or segments, that have imaging or printing already applied to the sheets, e.g. graphical depictions, before the sheets are provided to the manufacturing press. The printing is provided in pre-defined areas, determined prior to production, to create individual segments than can be used for a number of purposes. The templates or segments are then cut from the sheet and supplied to a feeder mechanism. The templates, sheets, ribbons or segments are then applied to the web via the use of a unique rotary positioning device in a number of patterns, including substantially edge-to-edge configuration, with a slight overlap or alternatively, provided in regularly occurring increments depending on the needs of the particular application to be serviced. In addition, the product produced in connection with the present process described in the instant application is also not limited in functionality as a number of materials, operations and options may be used in creating a relatively dynamic product. Such additional processes may include variable printing, embossments, coatings, over laminates and the like.

By preparing the intermediate prime label assembly in the manner described herein, the intermediate web can be processed continuously at speeds of greater than 50 feet per minute, preferably between 75-150 feet per minute and still more preferably at speeds of about 200 feet per minute or greater.

The system of the present invention can be used in the creation of a number of unique products such as webs that carry a series of labels, tags, cards, magnetic pieces, films and the like or mixtures of these elements. For example, a web can consist entirely of label segments or templates, or can have alternating and regular repeating arrangements of labels. Another element, such as cards, may have complete variability such that multiple elements are laid down in a particular sequence (label, card, magnetic, etc.) on a web.

In one exemplary embodiment of the present invention, a system for producing incremental laminates on a web is described and includes a carrier web that travels in a machine direction. A placer mechanism is used in the system and has a supply of previously prepared individual, discrete business communication ribbons disposed in a hopper. Each of the ribbons contains indicia printed in advance of being placed in the hopper. The placer mechanism has an out feed portion that individually dispenses each ribbon obtained from the supply that is contained within the hopper.

The system of the presently described embodiment includes a rotary positioning device for taking each of the ribbons from the out feed portion of the placer mechanism and positioning each of the ribbons on the carrier web in a regular configuration. The rotary positioning device has at least one ribbon receiving area for catching and holding each ribbon after it has been dispensed from the placer mechanism. The receiving area includes a dam that is formed integrally with the rotary positioning device. The rotary positioning device further includes at least one vacuum channel that is disposed beneath the ribbon receiving area in order to hold the ribbon on the rotary positioning device until the ribbon is placed on the carrier web.

The system of the present invention includes an incrementally laminated web that is formed by placing each of the ribbons on the carrier web in a regularly occurring pattern.

In a further embodiment of the present invention, a system for producing regularly sequenced assemblies of discrete, preprinted segments on a web is provided and includes a series of sheets with each sheet having a number of predefined areas that are intended to receive printing. Each of the sheets is cut into a number of individual segments with each segment having indicia provided thereon.

The presently described embodiment further includes a supply mechanism that is used for holding a collection of the segments in a separate fashion and in a previously determined sequential order. A placer device is provided for individually receiving each segment from the supply mechanism and for transferring each segment from the supply mechanism to a positioning cylinder.

The positioning cylinder has at least one segment collecting area. The area includes a leading edge that extends generally upwardly from a recessed surface of the cylinder and at least one orifice for applying a vacuum while the segment is in the area. The system utilized in the present embodiment is used in the formation of a continuous web which receives each of the segments from the positioning cylinder to create discrete, regularly occurring assemblies on the web.

In yet a still further embodiment of the present invention, a system for assembling an incrementally laminated web assembly is provided and includes a web unwind for supplying a continuous carrier web of material in a machine direction to an assembly point. A series of individual, pre-printed segments prepared from at least one sheet that was preprinted and cut into the individual segments and a supply device for holding the series of segments in a stack such that each segment may be handled separately.

The presently described embodiment further includes a feeder mechanism for feeding each segment one at a time from the supply device to a rotary placer. The rotary placer has at least one segment receiving portion for catching and temporarily retaining each segment in a predetermined positioned. The receiving portion includes a front edge for stopping the segment upon supply from the hopper and a vacuum slot for holding the segment in position in the portion. Each of the feeder mechanism and rotary placer mechanism are located at the assembly point.

The rotary placer rotates in order to place each segment on the continuous web at the assembly point so as to create an incrementally laminated web of discrete, preprinted segments.

These and other objects of the invention will become clear from an inspection of the detailed description of the invention and from the appended claims.

BRIEF DESCRIPTION OF THE DRAWINGS

These, as well as other objects and advantages of this invention, will be more completely understood and appreciated by referring to the following more detailed description of the presently preferred exemplary embodiments of the invention in conjunction with the accompanying drawings, of which.

DETAILED DESCRIPTION OF THE INVENTION

Figure 1:
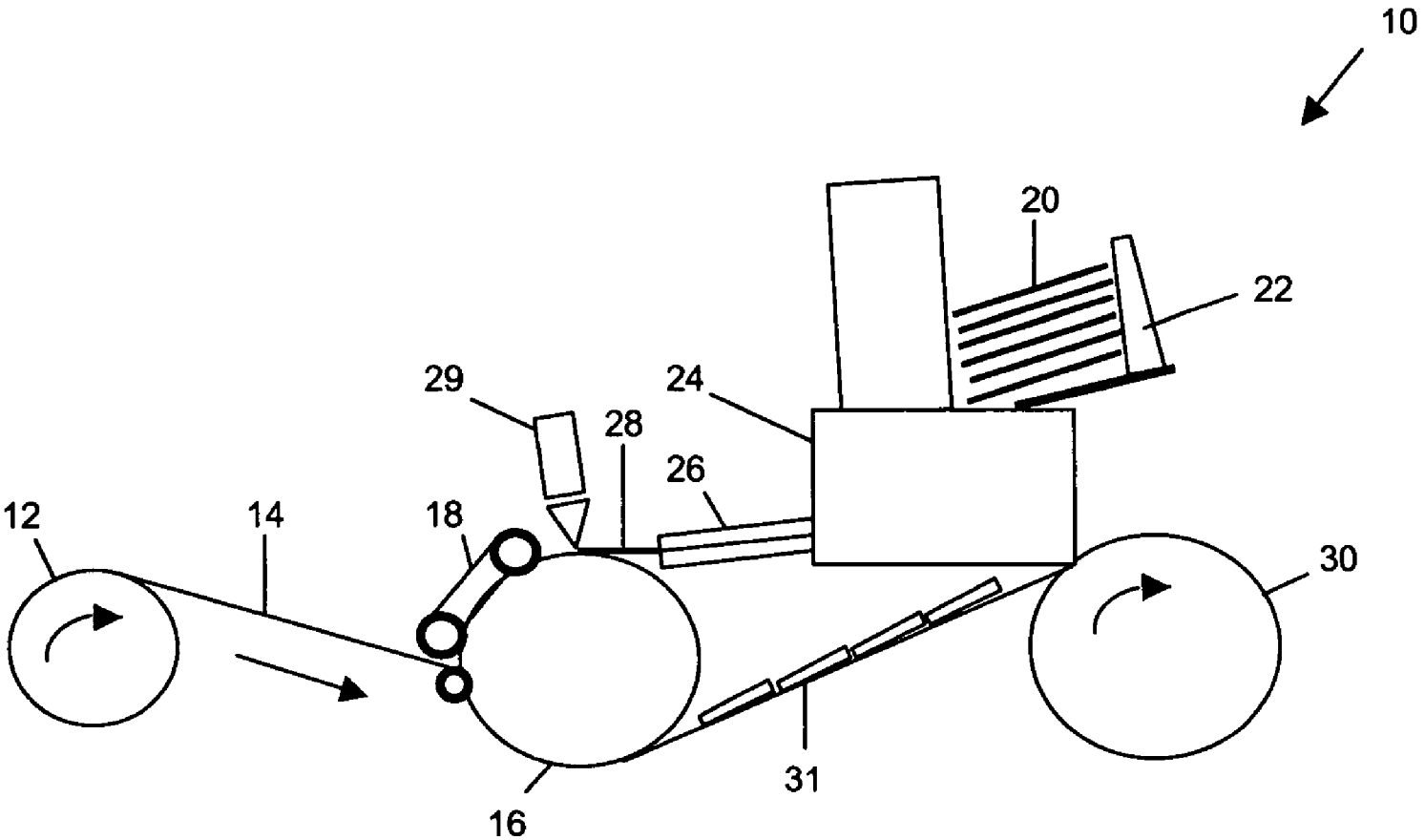
FIG. 1 depicts an exemplary schematic of a system used in practicing the present invention.

The present invention is now illustrated in greater detail by way of the following detailed description which represents the best presently known mode of carrying out the invention.

However, it should be understood that this description is not to be used to limit the present invention, but rather, is provided for the purpose of illustrating the general features of the invention.

The term "patterns" as used herein refers to strips, lines, shapes, spots, dots, elements and discontinuous segments, as well as regular and irregular placement of such items. Patterns may also refer to combinations of the above-mentioned items such that one pattern may be a continuous strip; another, segmented elements; and still further an irregular placement of elements or the like. Any combination of patterns is possible depending on the need or application of the manufacturer or the end user. In addition, the pattern can be prepared in order to accommodate a particular theme, season, event, trade dress, graphics, alpha and numeric characters, and the like. Patterns are used in connection with the present invention to describe the placement of the label segments or ribbons applied to the web or individual prime labels positioned on the web in a particular pattern or arrangement. Pattern as defined herein also is used in connection with the adhesive that is applied to the continuous web.

As used herein the term "business communication" is used to refer to a printed or imaged piece, document or substrate that, either alone or in combination with other documents, can convey a particular message, image or provide information about a particular product or service that is available from the provider of such pieces or documents. Business communication documents or pieces can include advertising, sales and marketing collateral and such other items used to convey information on written or imaged form sheets, brochures, presentation folders, informational sheets and combinations thereof.

The term "personalized information" refers to information that is printed or imaged onto a substrate or document which is generally variable or unique and which may change from document to document or segment to segment so as to create a customized message or communication for each recipient. Examples of personalized information may include names, addresses, descriptions, plans, coding, numbering, promotional text, etc. that may have been acquired from the intended recipient through surveys, questionnaires or answers given to various inquiries generated in response to a request for goods or services.

The term "static or fixed" information refers to printed or imaged information that generally does not change from document to document or segment to segment and may include a general description or body of information about particular products, services, places, etc. that may be of interest to the intended recipient and represents a standard message that the manufacturing or supplier wishes to convey to an end user or customer of the offering.

The term "intermediate" as used herein refers to a product that undergoes one or more processing steps prior to the intermediate reaching a final condition, that of being ready for end use or application. The additional processing steps may include printing, imaging, folding, sealing, separating, cutting, perforating, scoring, adhering and the like. Typically, a product such as with the present invention is provided in an intermediate condition so that a user can add or manipulate the intermediate to create the final or desired end product, such as applying the prime label to a container, carton or the like. Thus, in accordance with the present invention, the intermediate segment for example, could be subject to die cutting or additional printing, such as through ink jetting, over laminating, coating or embossment, and then applied to a container, carton, consumer package good or the like.

The term "sheets" or "segments" as used herein refers to sheets, segments, ribbons, strips, pieces, parts, sections, subdivisions and combinations thereof. The sheet or segment provided as an example for the purposes of this specification can be an entire sheet such as 8½"×11", 11"×14", 19"×25" and other known sheet sizes or may be segments, divisions, strips, etc. of such sheets. For example, a 19"×25" sheet may be produced with five rows of labels, with each row having six labels, with each label having dimensions of approximately 3"×4". For instance, in this example, each row may comprise an individual segment or sheet that may be used in practicing the present invention. It should, however, be understood that the invention is not to be so limited to the foregoing configuration and that individual pieces or elements, regardless whether the piece or elements have a regular or irregular shape, may be used in connection with this process to produce the intermediate assembly that is described in this application.

As used herein, the term "templates", "segment", "ribbon" or "element" refers to a particular size, configuration or arrangement of a piece. For example, if the template or segment is a label, the label may have a size of 2"×4", 1"×2" and other sizes that may be customarily produced. Likewise, if the piece is a card, the card may have a size ranging from 3"×5", 2"×4" or any other suitably sized card. The term templates can be used to refer to segments, ribbons and similar terms.

Through use of the present invention, a vast array of identifiers, e.g. printed pieces, labels, tags, cards, plates, magnets, laminates, etc. can be placed on an adhesive coated web and then collected for later use, thereby creating a versatile pressure sensitive intermediate web assembly. Through the use of the foregoing process, a manufacturer may create innumerable high quality graphics, illustrations and variable and personalized text and indicia to create a greater impact on the potential consumer or end user. The foregoing process has a number of benefits over conventional technologies in that the process can occur at roughly equivalent press speeds and may be handled by conventional applicators.

Turning now to FIG. 1 of the presently described invention, a schematic of the system used to produce an incrementally laminated web assembly is generally depicted by reference to numeral 10. The system includes a web unwind unit 12 which supplies a continuous carrier web 14 to an assembly point. The assembly point includes a rotary positioning device 16, segment retaining belt 18 and feeder unit coupled with a supply to be described herein. A series of segments 20, that have been cut from a number of pre-printed sheets (not shown) are provided to supply device or hopper 22.

Examples of image generating or high quality printing devices that are suitable for use in practicing the invention include high resolution imaging devices such as Indigo®, available from Hewlett Packard of Palo Alto, Calif. or Karat available from KBA of Williston, Vt. Ideally, the present invention seeks to provide a segment or intermediate with a series of segments that has a quality of about 150 or more lines per inch and preferably more than 300 lines per inch, which is approximately equal to about 2500 to 3500 dots per inch ("DPI") in order to create a high quality image that is intended to be aesthetically appealing to the consumer.

The segments 20 are provided in a stack such that the individual segments can be fed one at a time to the feeder device 24. The segments are preferably placed face down in the stack; printing has been provided on the face. The feeder device 24 accepts each segment 20 from the supply and then the segment passes through the out feed end 26 of the unit.

The individual segment 28 is then passed to the rotary positioning cylinder 16 and into a segment receiving area, to be described later.

Still referring to FIG. 1, an adhesive applicator 29 may be used to apply a pattern of adhesive to the back face of segment 28 as it passes around the rotary positioning cylinder. In the event an adhesive is applied to the back of the segment prior to the segments entry into the segment retaining belt 18, then the belt 18 may be provided with a high release material such as silicone to prevent the segment from sticking to the belt. The segment is then advanced around the cylinder 16 and placed adhesive side down on the face of the web 14 to create an incrementally laminated web 31 which is then collected by a rewinder 30. Alternatively, the individual segments may be free of adhesive and the web 14 would be provided with a pattern of adhesive and the segments brought into contact with the adhesive.

Preferably the system 10 will operate continuously at greater than 50 feet per minute and still more preferably at greater than 150 feet per minute. While the system has been described as preparing a continuous web, it should be understood that the web may be cut into individual portions or sheets, with each portion or sheet containing an order or a predetermined amount of a particular order or job.

Figure 2:
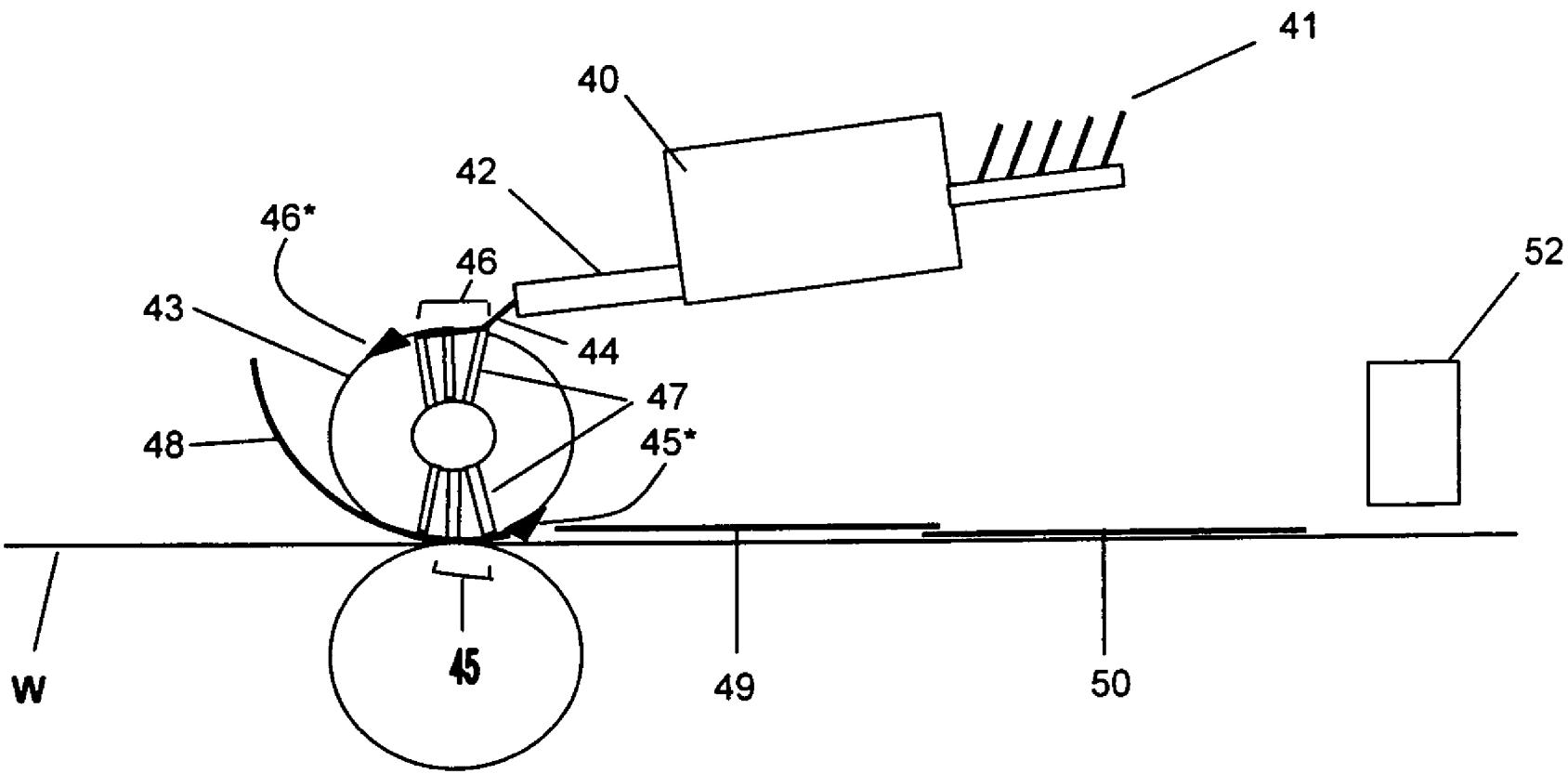
FIG. 2 provides a further schematic of the rotary positioning device that is used in the practice of the present invention.

Reference is now directed to FIG. 2 of the present invention which shows an enlarged schematic of the exemplary placer mechanism used in carrying out the present invention. An exemplary feeder or placer mechanism that is used in the practice of the present invention is provided under the name Maverick® and is available from In-Line Automation of Minneapolis, Minn. The exemplary unit may use a vacuum cylinder to take the segments from the hopper and then deposit the individual segments sequentially on the surface of the web over an adhesive in a machine direction. It should be understood that the invention is not limited by the type of placer mechanism used in the present example.

The feeder mechanism 40 is provided with a supply of previously prepared individual segments from a hopper 41. The segments are taking individually from the supply 41 and passed through an out feed 42 to the rotary positioning cylinder 43. The rotary device 43 is provided with one and preferably two segment receiving or holding areas 45 and 46 which are disposed approximately 180 degrees from one another around the periphery of the cylinder. It should be understood that the cylinder may utilize more than two holding areas, such as four with each area positioned at 90 degree increments around the periphery of the positioning device.

The segment holding or receiving areas 45 and 46 are each provided with a front edge or dam 45* and 46* respectively. The front edge will extend generally upwardly from a slightly recessed area in the periphery of the rotary positioning device. Each of the receiving areas is also provided with a series of vacuum slots 47 which are used to aid in holding the segment 44 and 48 in position on the rotary device 43 until the sheet is positioned on the surface of the web "W."

The rotary device 43 will rotate and place each of the segments 48, 49 and 50 on the web "W". As shown from FIG. 2, the segments are placed in a slightly overlapping arrangement and may then pass beneath a die cutting station 52 which will cut the final shape of the labels. The overlap between the segments is preferably about one quarter of an inch to about one sixteenth of an inch with about one eighth of an inch, or such amount so as to accommodate a matrix portion that will be severed from the label portion when the die cutting operation is performed. The matrix portion will be at least equivalent to the area of the overlap between the successive segments.

Figure 3:
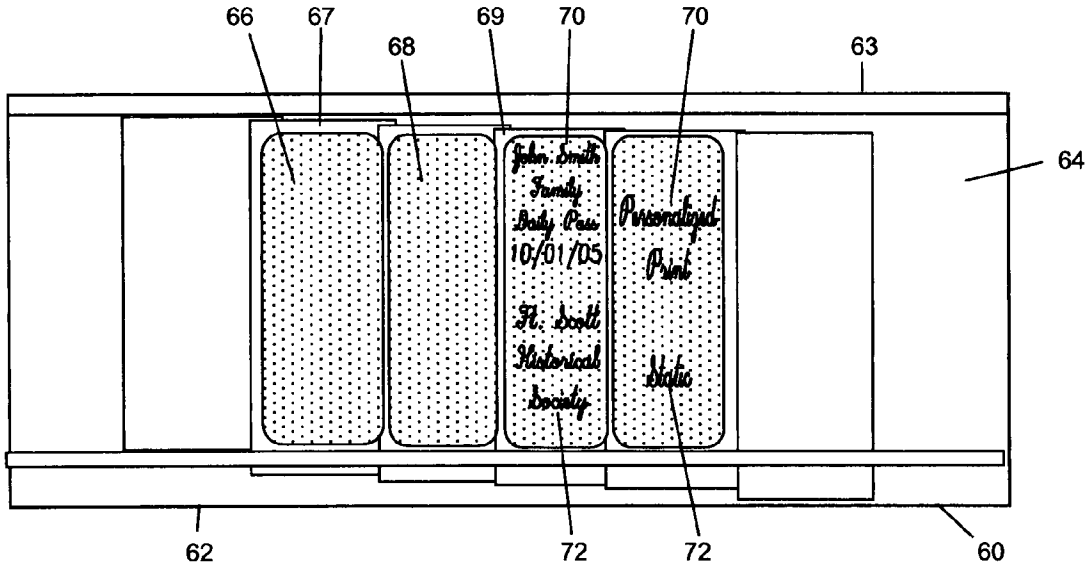
FIG. 3 shows a top view of an exemplary intermittently laminated web as prepared in accordance with the present invention.

Turning now to FIG. 3, an exemplary incrementally laminated web is generally depicted by reference to numeral 60. The web is shown with the segments slightly offset from the longitudinal edge of the carrier web for purposes of illustrating the offsetting capability of the system. It should, however, be understood that the segments will preferably be placed one after the other such that the end edges are aligned with one another.

The web 60 in FIG. 3 includes first and second longitudinally extending sides 62 and 63 and having a first face 64. The carrier web 60 may be provided with adhesive in the event that adhesive is not coated on the back face of the individual segments when the segments are applied to the web. The segments 66 and 68 for example are placed in a slightly overlapping configuration such that the matrix portion 67 and 69 covers at least the area of the overlap. Each of the segments can be printed with personalized printing, static or fixed printing as shown by numerals 70 and 72.

Figure 4:
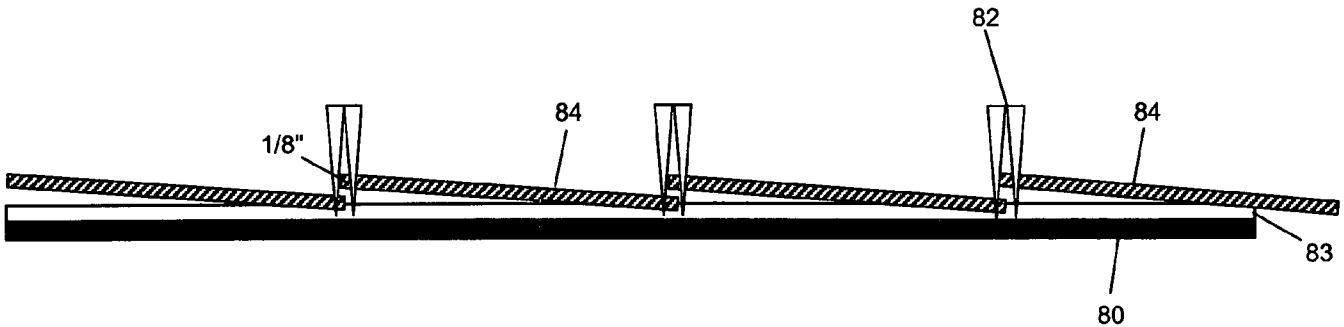
FIG. 4 illustrates a side view of the intermittently laminated web shown in FIG. 3.

FIG. 4 shows a cross section of the incrementally laminated web shown in FIG. 3 and includes a carrier web 80. It should be understood that the carrier web can be a continuous material having a width that is about the same as the orientation of the segments or alternatively, the web may be constructed of a lattice of strings or threads to carry the segments through the machine and to the next processing station.

The web 80 shown in FIG. 4 includes an adhesive layer 83 and a series of segments 84 disposed over the pattern of adhesive 83. The segments are shown in a slightly overlapping configuration as illustrated by brackets 82. As previously described, the slight overlap will have the approximate width of the matrix portion that is to be removed after a step of die cutting.

Through use of the present invention, an incrementally laminated web of high quality segments may be assembled such that various products and materials can be delivered to an end user without the need for acquiring expensive equipment. The system may be used to create continuous webs of material as well as cut sheets that may contain separate orders or different parts of a single order without the necessity of resetting equipment for the manufacturing operation.

It will thus be seen according to the present invention a highly advantageous system for producing incrementally laminated webs has been provided. While the invention has been described in connection with what is presently considered to be the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of the appended claims so as to encompass all equivalent structures and products.

The inventors hereby state their intent to rely on the Doctrine of Equivalents to determine and assess the reasonably fair scope of their invention as it pertains to any apparatus, system, method or article not materially departing from but outside the literal scope of the invention as set out in the following claims.

The invention claimed is:

1. A system for assembling an incrementally laminated web assembly, comprising;

a. a web unwind for supplying a continuous carrier web of material in a machine direction to an assembly point;

b. a series of individual, preprinted segments prepared from at least one sheet that was preprinted and cut into said individual segments;

c. a supply device for holding said series of segments in a stack such that each segment may be handled separately;

d. a feeder mechanism for feeding each segment one at a time from said supply device to a rotary placer;

e. said rotary placer having at least one segment receiving portion for catching and temporarily retaining each segment in a predetermined position, said receiving portion including a front edge for stopping said segment upon supply from said hopper and a vacuum slot for holding said segment in position in said portion;

f. each of said feeder mechanism and rotary placer mechanism are located at said assembly point; and g. wherein said rotary placer rotates to place each segment on said continuous web at said assembly point so as to create an incrementally laminated web of discrete, preprinted segments;

h. said rotary placer mechanism having at least a second receiving portion that is positioned approximately 180 degrees around a circumference of said placer mechanism from said first receiving portion, and said second portion having a front edge for stopping said segment upon supply from said hopper and a vacuum slot for holding said segment in position in said portion.

* * * * *